US011993872B2

(12) United States Patent
Myogi et al.

(10) Patent No.: US 11,993,872 B2
(45) Date of Patent: May 28, 2024

(54) LOOM

(71) Applicant: TSUDAKOMA KOGYO KABUSHIKI KAISHA, Ishikawa-ken (JP)

(72) Inventors: Keiichi Myogi, Ishikawa-ken (JP); Daigo Yamagishi, Ishikawa-ken (JP); Koichi Tamura, Ishikawa-ken (JP); Kazuya Yama, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 32 days.

(21) Appl. No.: 17/728,626

(22) Filed: Apr. 25, 2022

(65) Prior Publication Data

US 2022/0356613 A1 Nov. 10, 2022

(30) Foreign Application Priority Data

May 6, 2021 (JP) ..... 2021-078596
Feb. 14, 2022 (JP) ..... 2022-020110

(51) Int. Cl.

*D03D 49/00* (2006.01)
*D03D 49/10* (2006.01)
*D03D 51/02* (2006.01)
*D03D 51/00* (2006.01)

(52) U.S. Cl.

CPC ..... *D03D 49/10* (2013.01); *D03D 51/02* (2013.01)

(58) Field of Classification Search

CPC ..... D03D 49/10; D03D 51/02; D03D 49/02; D03D 49/06; D03D 49/62; D03D 49/027

See application file for complete search history.

(56) References Cited

U.S. PATENT DOCUMENTS 530,647 A * 12/1894 Martin ..... D03D 49/06 139/110
728,961 A * 5/1903 Muldowney ..... D03D 49/06 139/113
1,339,507 A * 5/1920 Hathaway ..... D03J 1/14 28/205

(Continued)

FOREIGN PATENT DOCUMENTS

EP 2141269 B1 3/2011
JP S48-044556 A 6/1973

OTHER PUBLICATIONS

Sep. 27, 2022, European Search Report issued for related EP Application No. 22170011.5.

*Primary Examiner* — Robert H Muromoto, Jr.
(74) *Attorney, Agent, or Firm* — Paratus Law Group, PLLC

(57) ABSTRACT

A loom including a drive transmission shaft connected to a warp beam via a gear member inside a loom frame and inserted in a through-hole formed in a side frame, and a support structure for supporting the drive transmission shaft, the support structure including a first bearing and a second hearing externally fitted to the drive transmission shaft at an interval in an axis line direction. The support structure includes a first bearing case configured to accommodate therein the first bearing and attached to the side frame inside the loom frame and a second bearing case configured to accommodate therein the second bearing and attached to the side frame outside the loom frame.

2 Claims, 6 Drawing Sheets

(56) References Cited

U.S. PATENT DOCUMENTS

| | | | | | |
|---|---|---|---|---|---|
| 1,994,296 | A * | 3/1935 | Williamson | D03J 1/14 | 28/208 |
| 2,533,128 | A * | 12/1950 | Mallard | D03D 49/02 | 139/1 R |
| 2,994,939 | A * | 8/1961 | Matthews | D02H 13/38 | 254/338 |
| 3,122,172 | A * | 2/1964 | Honegger | D03D 49/06 | 139/110 |
| 3,675,686 | A * | 7/1972 | Steiner | D03J 1/00 | 28/208 |
| 3,810,493 | A * | 5/1974 | Mizuno | D03D 49/06 | 139/110 |
| 4,155,380 | A * | 5/1979 | Gattiker | D03D 49/06 | 139/97 |
| 5,305,801 | A * | 4/1994 | Rupflin | D03C 1/142 | 74/89.17 |
| 5,307,844 | A * | 5/1994 | Gruwez | B23Q 1/0063 | 28/208 |
| 5,322,088 | A * | 6/1994 | Sampers | D03J 1/00 | 28/208 |
| 5,371,930 | A * | 12/1994 | Lindenmueller | D03J 1/001 | 28/208 |
| 11,649,573 | B2 * | 5/2023 | Myogi | D03C 9/0608 | 139/93 |
| 2022/0098765 | A1 * | 3/2022 | Myogi | D03D 49/027 | |
| 2022/0127763 | A1 * | 4/2022 | Myogi | D03D 49/60 | |
| 2022/0356613 | A1 * | 11/2022 | Myogi | D03D 49/10 | |
| 2023/0112881 | A1 * | 4/2023 | Myogi | D03D 51/02 | 139/1 R |

* cited by examiner

LOOM

CROSS-REFERENCE TO RELATED APPLICATION(S)

This application is based on and claims priority under 35 USC 119 from Japanese Patent Applications No. 2021-078596 filed on May 6, 2021, and No. 2022-020110 filed on Feb. 14, 2022, the contents of which are incorporated herein by reference.

TECHNICAL FIELD

The present invention relates to a loom including a drive transmission shaft connected to a warp beam via a gear member inside a loom frame including a pair of side frames, the drive transmission shaft being inserted in a through-hole formed in the side frame; and a support structure for supporting the drive transmission shaft, the support structure including a first bearing and a second bearing externally fitted to the drive transmission shaft at an interval in an axis line direction.

BACKGROUND ART

In a loom, a drive mechanism configured to rotationally drive a warp beam includes a gear member such as a pinion gear in mesh with a beam gear of the warp beam, a drive transmission shaft having one end portion to which the gear member is fixed, and a gear train configured to connect the drive transmission shaft and a drive source. Note that, in a general loom, since the drive source is arranged outside the loom frame, the connection of the drive source and the drive transmission shaft by the gear train is also performed outside the loom frame. Therefore, the drive transmission shaft connected to the warp beam (beam gear) via the gear member inside the loom frame extends toward the outside of the loom frame in a form of being inserted in a through-hole formed in a side frame, on a side (drive mechanism-side) on which the drive mechanism is provided, of a pair of side frames of the loom frame.

The drive transmission shaft is supported with respect to the side frame on the drive mechanism-side by a support structure attached to the side frame on the drive mechanism-side. Note that, the support structure includes two bearings (a first bearing and a second bearing) that are provided on the drive transmission shaft for support at an interval in an axis line direction of the drive transmission shaft. The drive transmission shaft is rotatably supported with respect to the support structure in such a form that the two bearings are externally fitted thereto at an interval in the axis line direction. PTL 1 also discloses a loom having such a support structure.

CITATION LIST

Patent Literature

PTL 1: JPS48-044556A

In the meantime, according to the loom disclosed in PTL 1, the support structure is configured such that the first bearing and the second bearing are accommodated in a bracket (bearing case) attached to the side frame. That is, the support structure is configured so that the first bearing and the second bearing are accommodated in the common (single) bearing case. Note that, the bearing case has a configuration where a part in which both the bearings are accommodated is formed in a cylindrical shape extending in the axis line direction so that the first bearing and the second bearing are externally fitted to the drive transmission shaft at an interval in the axis line direction as described above, and is attached to the side frame on one end-side of the cylindrical part.

Note that, in a general loom, the loom frame vibrates violently during weaving due to influences of shedding motion of a heddle frame of a shedding device, a beating operation of a beating device, and the like. Therefore, the warp beam supported by the loom frame (side frame) also vibrates violently during weaving. The warp beam vibrates in this way, so that the drive transmission shaft connected to the warp beam (beam gear) via the gear member also vibrates.

As the drive transmission shaft vibrates in this way, the vibration is transmitted to the bearing case in which both the first and second bearings are accommodated, via the first bearing and the second bearing externally fitted to the drive transmission shaft. That is, the bearing case is in a state of receiving, from the bearing, a force in a direction of the vibration. In the support structure of PTL 1 where the bearings are accommodated in the bearing case attached to the side frame as described above, a second bearing, which is one of the two bearings, is apart from an attaching position of the bearing to the side frame. Therefore, when the bearing case receives the force due to the vibration from the second bearing, the force and a moment force corresponding to a distance between the attaching position of the bearing case in the axis line direction and the second bearing act on an attaching portion of the bearing case.

In particular, in the support structure of PTL 1, as described above, the part in which the two bearings are accommodated has a (long) cylindrical shape extending in the axis line direction, the first bearing is accommodated on the one end-side (a side attached to the side frame) and the second bearing is accommodated on the other end-side. For this reason, a position of the second bearing is largely spaced from the attaching position in the axis line direction. That is, the support structure has a large distance between the attaching position in the axis line direction and the position of the second bearing. For this reason, the moment force that acts on the attaching portion of the bearing case described above is also a large force due to the large distance. Furthermore, in the support structure, since the two bearings are accommodated by the single bearing case, a force that is caused to act on the bearing case by the first bearing is also applied to the attaching portion, in addition to the force (moment force) by the second bearing as described above.

As the loom frame vibrates violently as described above, such force acts on the attaching portion at an extremely high frequency. For this reason, although the bearing case is fixed at the attaching portion to the side frame by a screw member, there are concerns that wear and the like may occur at the attaching portion, and therefore, an attached state may be loose. If the loom is operated at high speed in a state where the attached state of the bearing case is loose, the bearing case vibrates more violently, and therefore, the bearing case and the screw member may be damaged.

Further, if the attached state of the bearing case becomes loose, an impact due to vibration associated with the same acts on both the bearings, resulting in damage to the bearings and unstable support of the drive transmission shaft. As a result, there may occur a problem that the drive transmission shaft, the gear member configured to connect the drive transmission shaft and the beam gear of the warp beam, and the like are damaged.

SUMMARY

Therefore, in order to prevent the respective constitutional components (the bearing case, the drive transmission shaft, both the bearings, the gear member, and the like) of the drive mechanism from being damaged due to vibration of the loom, an object of the present invention is to provide a loom having a support structure for a drive transmission shaft capable of reducing the force, which acts on an attaching portion of a bearing case due to the vibration, as much as possible.

A preamble of the present invention is a loom including a drive transmission shaft connected to a warp beam via a gear member inside a loom frame including a pair of side frames, the drive transmission shaft being inserted in a through-hole formed in the side frame; and a support structure for supporting the drive transmission shaft, the support structure including a first bearing and a second bearing externally fitted to the drive transmission shaft at an interval in an axis line direction.

In addition, in order to achieve the above object, the loom of the preamble of the present invention is characterized in that the support structure includes a first bearing case configured to accommodate therein the first bearing and attached to the side frame inside the loom frame, and a second bearing case configured to accommodate therein the second bearing and attached to the side frame outside the loom frame.

In addition, in the loom of the present invention, the first bearing case and the second bearing case may be attached to the side frame by a common screw member.

According to the present invention, the support structure is configured such that, the first bearing and the second bearing are not accommodated in a common bearing case but are accommodated in the first bearing case and the second bearing case that are provided corresponding to the respective bearings and are respectively attached to the side frame inside and outside the loom frame. Therefore, each bearing case can be configured so that the bearing to be accommodated therein can be arranged at a position closer to the side frame, as compared to a configuration where the two bearings are accommodated spaced in the axis line direction. Each bearing case is configured in this way, so that a distance between an attaching position to the side frame and a position of the bearing becomes small in each bearing case. Therefore, the moment force (more specifically, the moment force that acts on the attaching portion of the bearing case as each bearing case receives a force from the bearing accommodated therein due to the vibration) becomes small.

Moreover, since the support structure is configured so that the bearing case is provided for each bearing, the force that is caused to act on the bearing case by the bearing due to the vibration is also received by the corresponding bearing case for each bearing. Therefore, the force that acts on the attaching portion of each bearing case becomes smaller, as compared to a case where the two bearings are accommodated in a common bearing case.

Therefore, according to the support structure in the present invention, the force that acts on the attaching portion of each bearing case due to the violent vibration of the loom frame during weaving can be made as small as possible, as compared to the configuration of the related art. Thereby, it is possible to suppress wear and the like occurring on the attaching portion, which are caused due to the force acting on the attaching portion of each bearing case, and as a result, it is possible to suppress damage to each constitutional component of the drive mechanism.

Further, in the loom according to the present invention, the support structure is configured such that the first bearing case and the second bearing case are attached to the side frame by the common screw member. Therefore, each bearing case is attached to the side frame more firmly.

Specifically, each hearing case is attached to the side frame by the screw member. At this time, the first bearing case and the second bearing case are attached to the side frame by the common screw member, so that the attached state is such a state that both bearing cases are attached to the side frame in a form of sandwiching the side frame with both the bearing cases. That is, each bearing case is attached to the side frame in a state where a holding force by both the bearing cases generated as a result of tightening the screw member is applied to the side frame.

Thereby, a total frictional force generated between both the bearing cases and the side frame by the holding force becomes a holding force for holding each bearing case. Therefore, according to the configuration, since the holding force of each bearing case is greater than that of a case where each hearing case is individually attached to the side frame, each bearing case is more firmly attached to the side frame. Nate that, each bearing case is firmly attached in this way, so that even when a force due to the vibration (the moment force and the force that is caused to act on the bearing case by the bearing) is applied to each bearing case during weaving, the wear and the like are less likely to occur in each bearing case.

DESCRIPTION OF EMBODIMENTS

Figure 1:
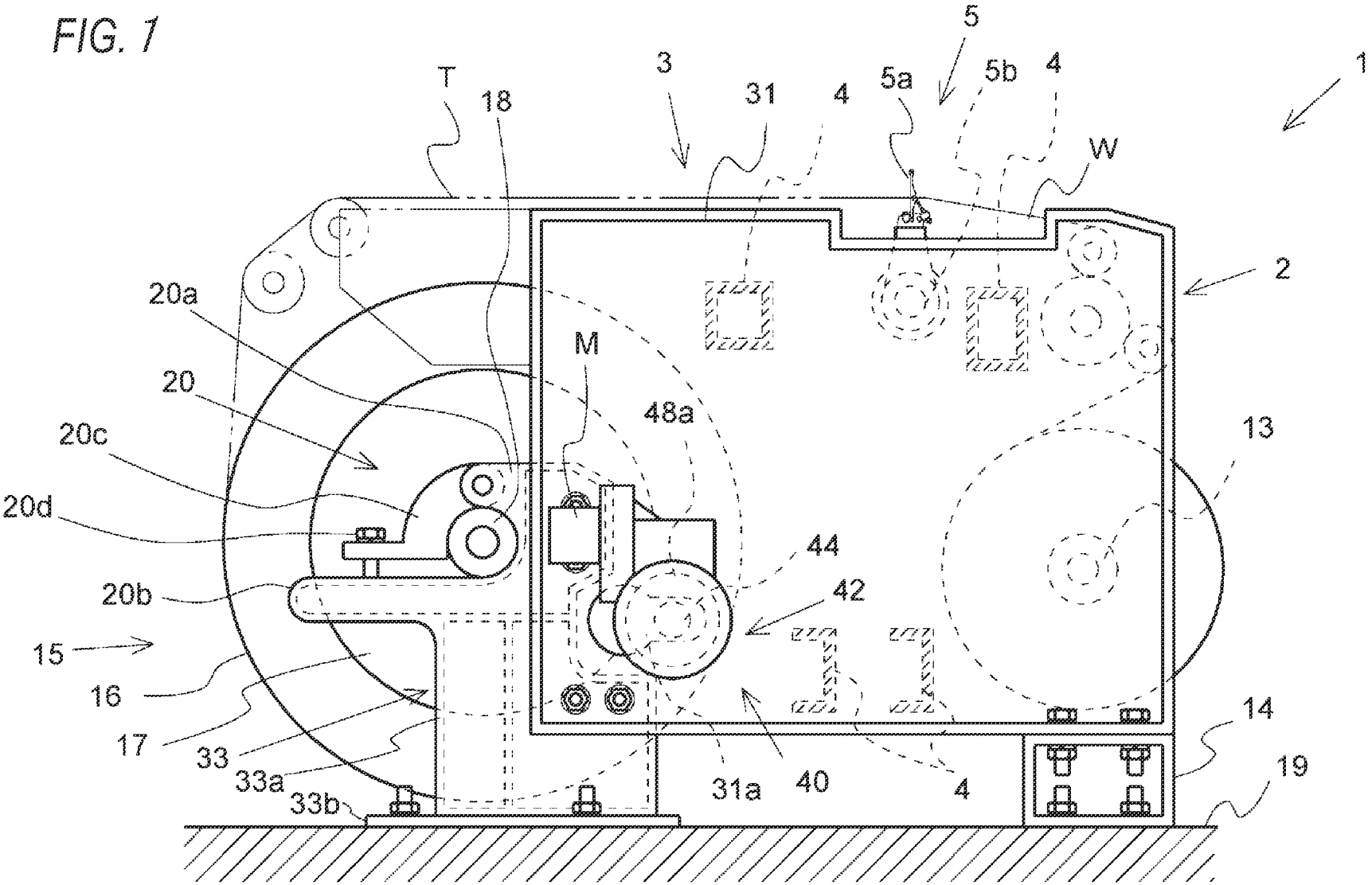
FIG. 1 is a side view of a loom to which the present invention is applied.

Hereinafter, one embodiment of the loom of the present invention will be described with reference to FIGS. 1 to 6.

In a loom 1, a loom frame 2 has a pair of side frames 3 and 3, as a main body, and bath the side frames 3 and 3 are connected in a state of facing each other in a width direction (thickness direction) by a plurality of beam members 4.

In addition, the loom 1 includes a reed 5*a* and a beating device 5 including a mechanism for swinging the reed 5*a*. The beating device 5 includes a locking shaft 5*b* that is driven to reciprocally rotate, a plurality of sley swords attached to the locking shaft 5*b*, and a sley which is supported by each sley sword and to which the reed 5*a* is attached. The locking shaft Sb is supported by both the side frames 3 and 3 in a form of being bridged between the pair of side frames 3 and 3, so that the beating device 5 is provided in a form of being supported by the pair of side frames 3 and 3.

In addition, the loom 1 includes a woven fabric beam 13 for winding a woven fabric W woven on a front side in a front-rear direction. As used herein, the front-rear direction is a direction orthogonal to a width direction of the loom 1

(a longitudinal direction of the beam member 4), as seen from above. Shaft portions of both ends of the woven fabric beam 13 are respectively supported by the side frames 3, so that the woven fabric beam 13 is also provided in a form of being supported by the pair of side frames 3 and 3.

The loom 1 also includes a warp beam 15 for delivering a warp T on a rear side in the front-rear direction. Note that, in the loom 1, each side frame 3 is provided with a beam support 20 for supporting the warp beam 15, Shaft portions of both ends of the warp beam 15 are supported by the respective beam supports 20, so that the warp beam 15 is provided in a form of being supported by the pair of side frames 3 and 3 via the pair of beam supports 20 and 20.

In the loom 1 as described above, each side frame 3 has a let-off frame 33, which is a part configured to support the warp beam 15 and formed as a separate body from a main body frame 31 that is a part configured to support the beating device 5 and the woven fabric beam 13. The let-off frame 33 is fixed to the main body frame 31, which is a main body part, thereby forming a part of the side frame 3. That is, each side frame 3 is constituted by the main body frame 31, which is a main part and is configured to support the beating device 5 and the woven fabric beam 13, and the let-off frame 33, which is fixed to the main body frame 31 and is configured to support the warp beam 15.

Figure 2:
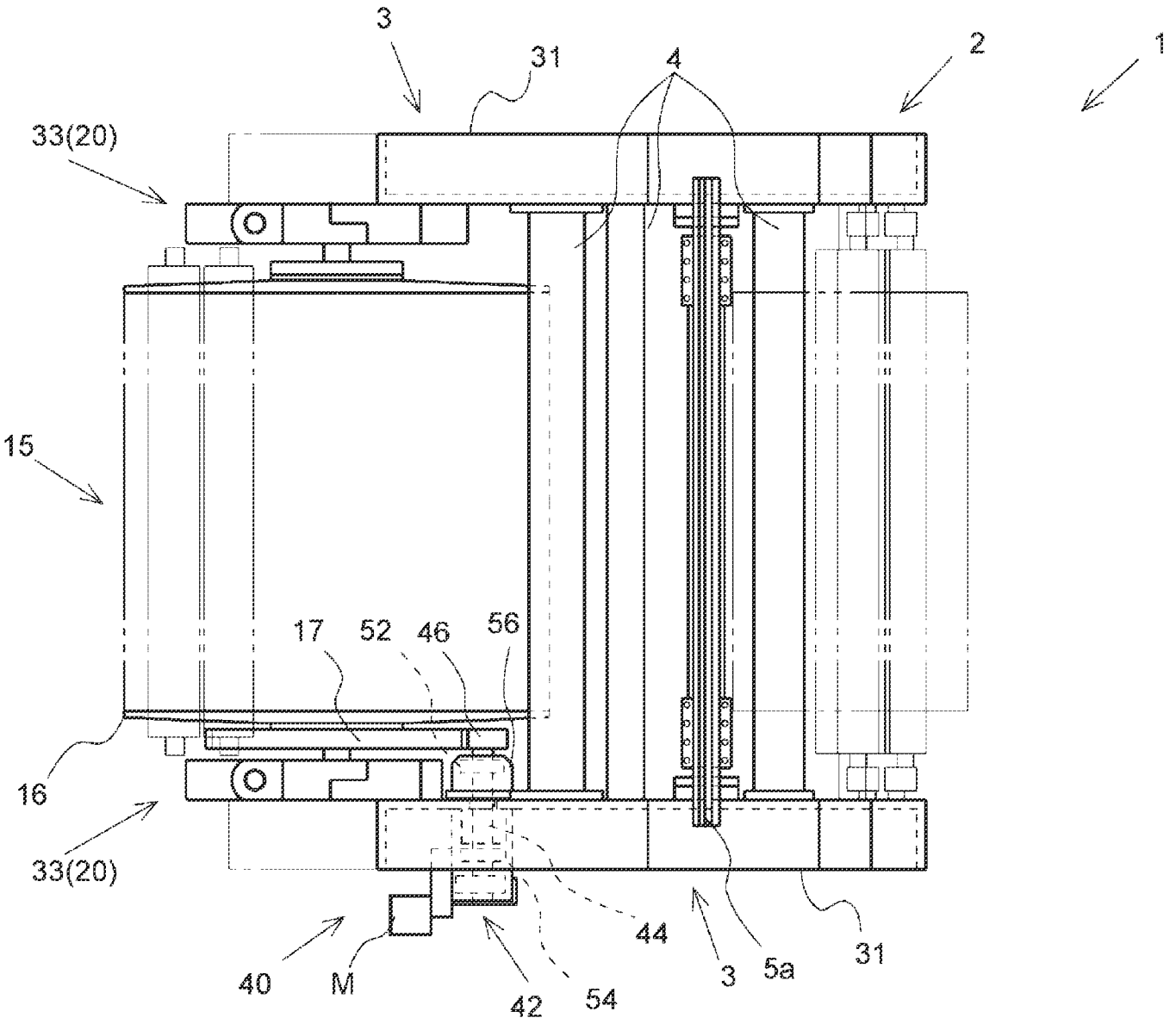
FIG. 2 is a plan view of the loom to which the present invention is applied.

Each side frame 3 is more specifically described. As shown in FIGS. 1 and 2, the main body frame 31 has a housing shape where an outer surface (outer wall) is opened. Both the side frames 3 and 3 are connected at the main body frames 31 by the beam members 4, as described above. For reference, the connecting position is a total of four places of two positions of upper portions and two positions of lower portions of the main body frame 31. However, the upper connecting positions are two positions, i.e., a position spaced forward from a central portion of the main body frame 31 and a position spaced rearward from the central portion in the front-rear direction. In addition, the lower connecting positions are two positions near the central portion.

Further, the main body frame 31 is installed on an installation surface (floor surface) 19 in a weaving factory or the like, but in the shown example, is installed on the installation surface 19 via a raising member 14 for adjusting a height position of the main body frame 31. Note that, the raising member 14 is a block-shaped member having a substantially cuboid shape, and is attached to a lower surface of the main body frame 31 by using a screw member such as a bolt. In addition, the main body frame 31 is installed (fixed) with respect to the installation surface 19 by fixing the raising member 14 to the installation surface 19 by an anchor bolt provided in a form of protruding from the installation surface 19.

In addition, the let-off frame 33 is a part of the side frame 3 configured to support the warp beam 15, and is integrally fixed to the main body frame 31 on a rear part-side of the main body frame 31. However, the warp beam 15 is in a state of being supported by the beam supports 20 on the loom 1, as described above. Therefore, the let-off frame 33 is configured to support the beam support 20. Further, in the loom 1 of the present embodiment, the let-off frame 33 and the beam support 20 are integrally molded, and each is a part of a single delivery structure.

Figure 3:
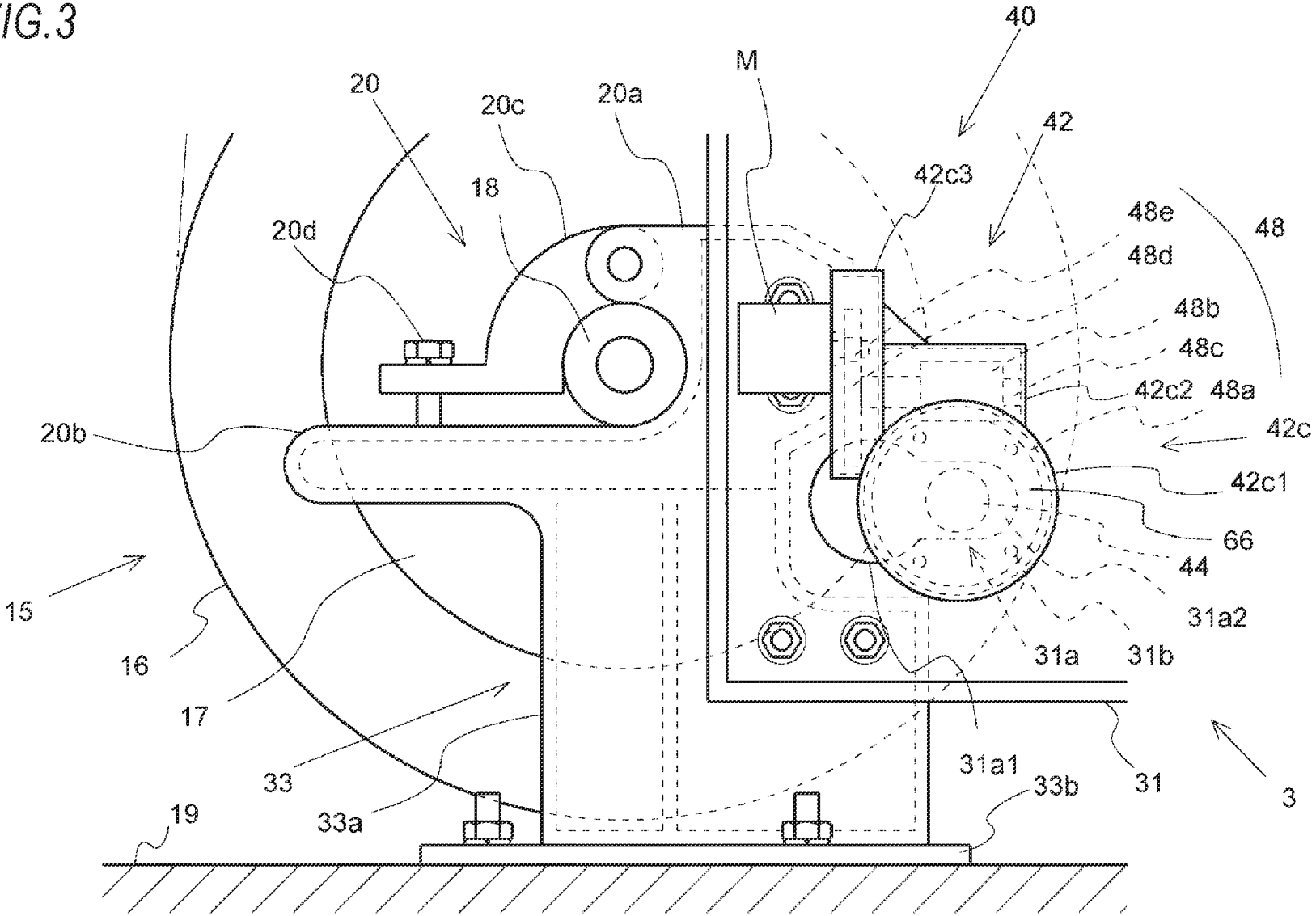
FIG. 3 is an enlarged view of main parts of FIG. 1.

As shown in FIG. 3, a part (let-off frame part) 33 of the delivery structure corresponding to the let-off frame is constituted by a base portion 33*h*, which is a portion installed (fixed) on the installation surface 19, and a support portion 33*a* having a substantially housing shape and provided in a form of standing upright on the base portion 33*b*. Note that, in the shown example, the support portion 33*a* is formed such that a side surface facing an inside thereof is opened and a reinforcing rib is formed near a central portion in the front-rear direction. Further, the support portion 33*a* is directly fixed with respect to the installation surface 19 on the base portion 33*b*, but in the fixed state, has such a height dimension that an upper end thereof is located above a lower surface of the main body frame 31 installed on the installation surface 19 via the raising member 14.

Further, in the delivery structure, a part above the let-off frame part 33 is a part (beam support part) 20 corresponding to the beam support. The beam support part 20 has a support portion 20*a* having an arc-shaped support surface for receiving a bearing 18 fitted to each shaft portion of both ends of the warp beam 15, and a guide portion 20*b* having an upper surface, which is continuous with the support surface so as to guide the warp beam 15, and extending rearward from the support portion 20*a*. In addition, the beam support part 20 has a clamp lever 20*c* for holding the warp beam 15 received by the support portion 20*a*. The clamp lever 20*c* is provided to be rotatable with respect to the support portion 20*a*, and is fixed to the guide portion 20*b* by a fixing means 20*d* such as a bolt so as to hold the warp beam 15 (bearing 18) received by the support portion 20*a*.

The delivery structure is fixed to an inner wall on the rear part-side of the main body frame 31. Specifically, the delivery structure is in a state of being located inside the side frame 3 in such arrangement that the guide portion 20*b* of the beam support part 20 is directed rearward and a part thereof overlaps the main body frame 31 in the front-rear direction. However, a positional relationship between the delivery structure and the main body frame 31 is such that the support surface of the beam support part 20 of the delivery structure is located behind a rear end of the main body frame 31 (the support portion does not overlap the main body frame 31). Further, the delivery structure is fixed to the main body frame 31 at a plurality of places by screw members such as bolts, in a state of being in contact with the inner wall of the main body frame 31 on an outer wall of the delivery structure in the above-described positional relationship in the front-rear direction.

Note that, the delivery structure is fixed with respect to the installation surface 19 on the base portion 33*b* of the let-off frame part 33 by an anchor bolt provided in a form of protruding from the installation surface 19, in a state of being fixed to the main body frame 31 as described above.

Figure 4:
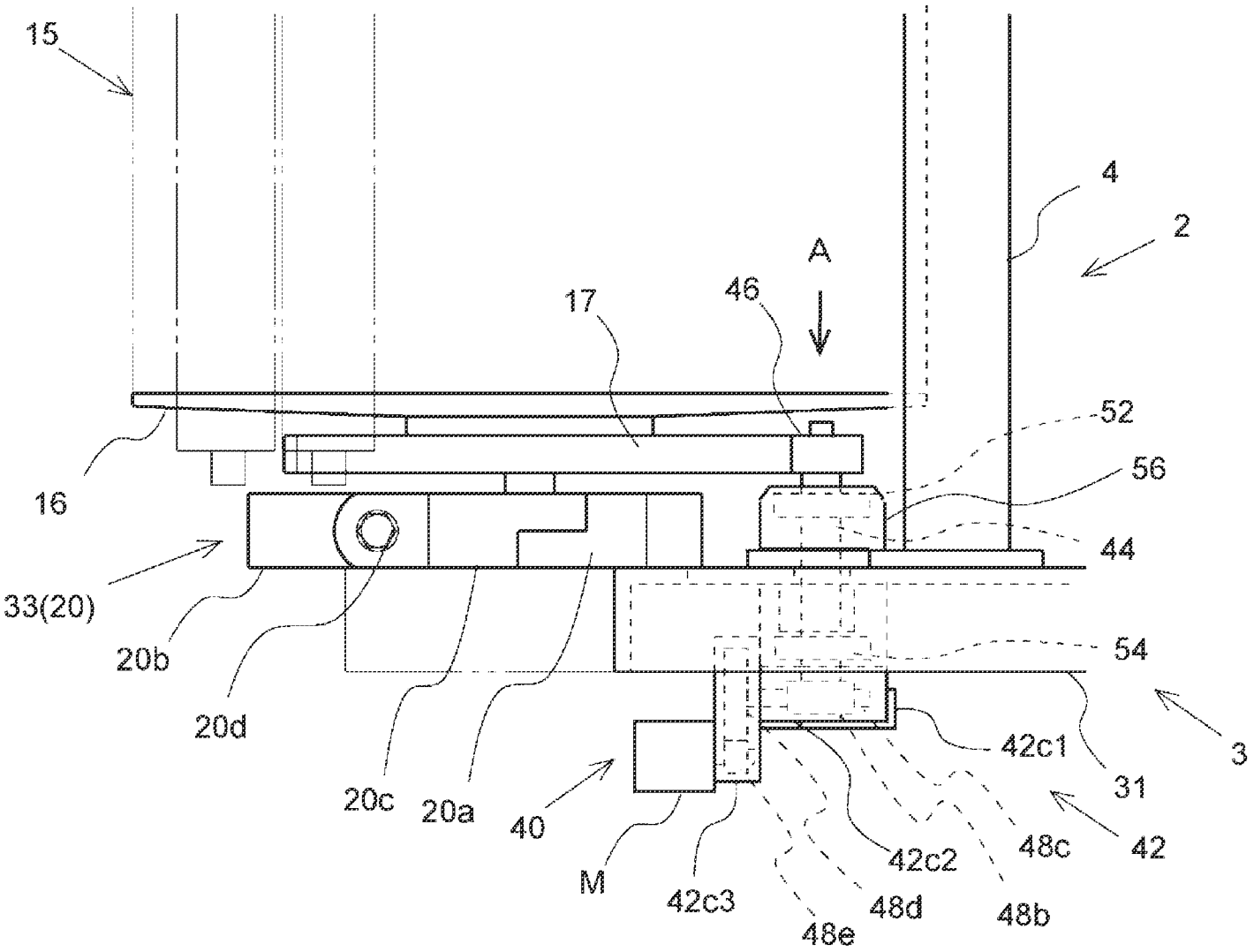
FIG. 4 is an enlarged view of main parts of FIG. 2.

The loom 1 also includes a drive mechanism 40 for rotationally driving the warp beam 15 supported by the beam support part 20 of the delivery structure. More specifically, as shown in FIG. 4, the warp beam 15 includes a beam gear 17 attached to an outer side of a beam flange 16. The drive mechanism 40 includes a delivery motor M as a drive source for rotationally driving the warp beam 15, a pinion gear 46 that is a gear member in mesh with the beam gear 17 of the warp beam 15, and a drive transmission shaft 44 connected to the warp beam 15 via the pinion gear 46 and having one end portion to Which the pinion gear 46 is fixed.

Further, as shown in FIG. 3, the drive mechanism 40 includes a gear train 48 for connecting an output shaft of the delivery motor M to the drive transmission shaft 44, in addition, the gear train 48 is constituted by a worm wheel 48*a* fixed to the other end portion of the drive transmission shaft 44, a worm shaft 48*c* including a worm 48*b* configured to mesh with the worm wheel 48*a*, a transmission gear 48*d* fixed to one end portion of the worm shaft 48*c*, and a motor gear 48*e* fixed to an output shall of the transmission motor M and configured to mesh with the transmission gear 48*d*.

The gear train 48 is accommodated in a gear case 42 attached to the main body frame 31 (side frame 3). Note that, the gear case 42 is provided in a form of being arranged outside the loom frame 2. Therefore, the drive transmission shaft 44 is provided in a form of being inserted in the main body frame 31.

Therefore, the main side frame 31 is formed with a through-hole 31*a* in which the drive transmission shaft 44 is inserted. As shown in FIG. 1, the through-hole 31*a* is formed at a position overlapping an outer peripheral edge of the beam gear 17 of the warp beam 15 at a lower portion on a rear part-side of the main body frame 31. Further, the through-hole 31*a* is formed in a key hole shape, and has a round hole portion 31*a*1 having a round hole shape and an elongated hole portion 31*a*2 having an elongated hole shape and formed to be continuous with the round hole portion 31*a*1. Note that, the elongated hole portion 31*a*2 is formed to extend in a direction parallel to the front-rear direction on a front side with respect to the round hole portion 31*a*1. In addition, the elongated hole portion 31*a*2 is formed at a position where a position of a center line thereof substantially coincides with a position of a center of the round hole portion 31*a* in an upper and lower direction.

Further, an inner diameter of the round hole portion 31*a*1 is slightly larger than an outer diameter of the pinion gear 46 fixed to the drive transmission shaft 44. On the other hand, a dimension of the elongated hole portion 31*a*2 in the upper and lower direction is slightly larger than a shaft diameter of the drive transmission shaft 44. Further, a dimension of the elongated hole portion 31*a*2 in a longitudinal direction is larger than the shaft diameter of the drive transmission shaft 44, and in the shown example, is about 1.5 times as large as the shaft diameter.

The drive transmission shaft 44 is provided to the main body frame 31 in a form of being inserted in the elongated hole portion 31*a*2 of the through-hole 31*a*, so that the drive transmission shaft is connected to the warp beam 15 via the pinion gear 46 inside the loom frame 2 and is connected to the output shaft of the delivery motor M via the gear train 48 outside the loom frame 2.

Further, the drive transmission shaft 44 is supported with respect to the main body frame 31 (side frame 3) by a support structure 50 attached to the main body frame 31. Note that, the support structure 50 includes two bearings (a first bearing 52 and a second bearing 54) so as to support the drive transmission shaft 44 at two places spaced apart from each other in an axis line direction. The drive transmission shaft 44 is rotatably supported with respect to the support structure 50 in such a form that the two bearings are externally fitted thereto.

In the loom described above, in the present invention, the support structure is configured to include a first bearing case configured to accommodate therein the first bearing and attached to the side frame inside the loom frame, and a second bearing case configured to accommodate therein the second bearing and attached to the side frame outside the loom frame. The present embodiment is an example where the first bearing case and the second bearing case are attached to the side frame 3 (main body frame 31) by a common screw member. The support structure is described in detail, as follows.

As shown in FIGS. 0.5 and 6, the first bearing case 56 is a member having, as a main body, a first support portion 56*a* that is a portion formed in a substantially cylindrical shape whose both ends are opened. The first bearing case 56 has a first attaching portion 56*b*, which is a portion formed in a flange shape, on one end-side in an axis line direction of the first support portion 56*a*. Note that, FIG. 5 is a view of the first bearing case 56 seen from an inside of the loom frame 2 (seen from a direction of an arrow A in FIG. 4), and FIG. 6 is a cross-sectional view taken along a line B-B in FIG. 5.

In addition, as shown, the first support portion 56*a* of the first bearing case 56 has a portion (protruding portion) 56*a*1 protruding slightly inward in a radial direction from the other end so that an opening on the other end-side is smaller than an opening on one end-side where the first attaching portion 56*b* is provided. Further, in the first bearing case 56, the first bearing 52 is accommodated in arrangement of being in contact with the protruding portion 56*a*1 at the first support portion 56*a*. Therefore, a dimension in the axis line direction of the first bearing case 56 (first support portion 56*a*) is larger than a thickness dimension of the first bearing 52, and in the shown example, is a size slightly smaller than an interval between the pinion gear 46 and the main body frame 31.

Figure 5:
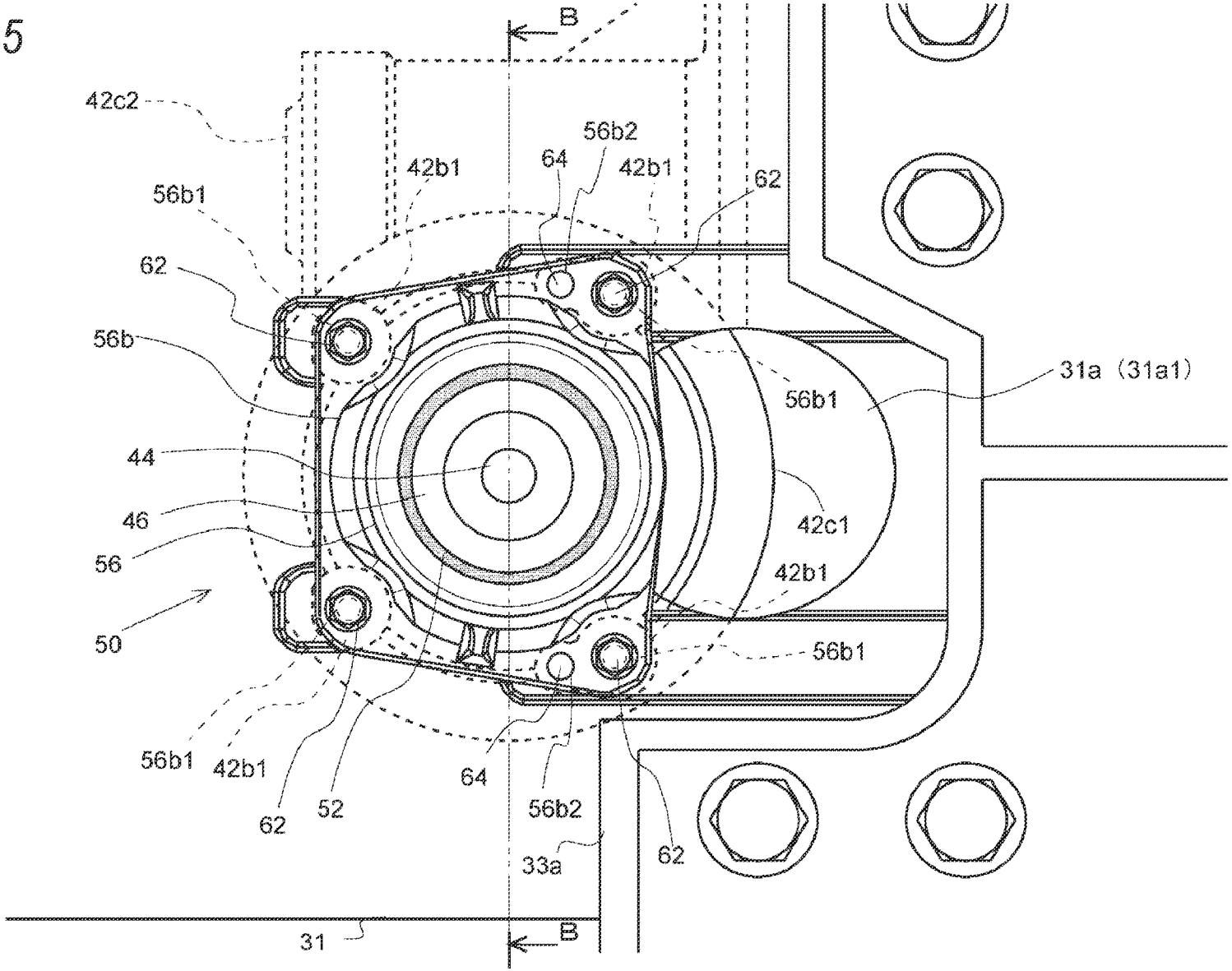
FIG. 5 is a view seen in a direction of an arrow A in FIG. 4.
Figure 6:
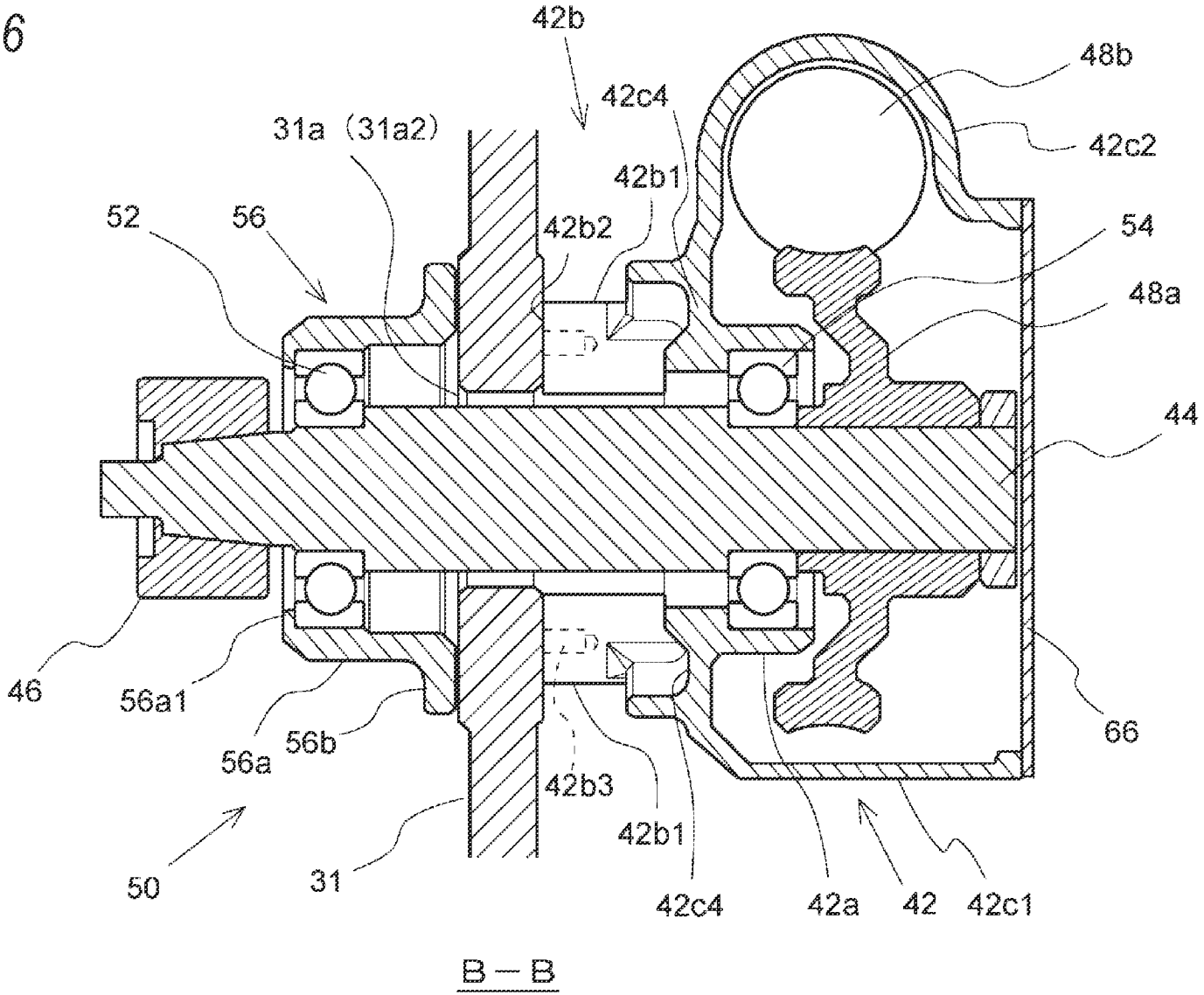
FIG. 6 is a sectional view taken along a B-B line in FIG. 5.

Further, as shown in FIG. 5, the first attaching portion 56*b* is formed in a substantially trapezoidal shape. The first attaching portion 56*b* is formed at its four corners with through-holes 56*b*1 into which screw members 62 for attaching the first bearing case 56 to the main body frame 31 are inserted. Note that, the first bearing case 56 is attached to the main body frame 31 in a state where a position of the first bearing case 56 is fixed (positioned) with respect to the main body frame 31 by using positioning pins 64. Therefore, the main body frame 31 is provided with two positioning pins 64 and 64 in a form of protruding from an inner surface (inner side wall) in the vicinity of upper and lower edges of the elongated hole portion 31*a*2 of the through-hole 31*a*. In addition, the first attaching portion 56*b* is formed with two positioning holes 56*b*2 and 56*b*2 in which the positioning pins 64 are inserted.

Further, as for the second bearing case, in the present embodiment, the gear case 42 described above is configured to accommodate a bearing, and the gear case 42 is adapted to serve as the second bearing case. That is, the gear case 42 is configured to have a second support portion 42*a* as a portion configured to accommodate therein the second bearing 54, in addition to a gear train accommodating portion 42*c* as a portion configured to accommodate the gear train 48 described above. Further, the gear case 42 of the present embodiment has, as its configuration, a second attaching portion 42*h*, which is a portion for attaching the gear case to the main body frame 31.

More specifically, as shown in FIGS. 3, 4 and 6, the gear train accommodating portion 42*c* is constituted by a wheel accommodating portion 42*c*1 configured to accommodate the worm wheel 48*a*, a worm accommodating portion 42*c*2 configured to accommodate the worm 48*b* and the worm shaft 48*c*, and a gear accommodating portion 42*c*3 configured to accommodate the transmission gear 48*d* and the motor gear 48*e*.

Among them, the wheel accommodating portion 42*c*1 has a substantially cylindrical shape whose both ends are opened. In addition, the wheel accommodating portion 42*c*1 is configured so that an inner diameter is slightly larger than an outer diameter of the worm wheel 48*a* so as to accommodate the worm wheel 48*a* and a dimension (about two times, in the shown example) in the axis line direction is larger than a dimension in a thickness direction of the worm wheel 48*a*. Further, the wheel accommodating portion 42*c*1 is formed so that an opening on one end-side thereof is smaller than an opening on the other end-side. Further, a disk-shaped cover member 66 is attached to the other end of the wheel accommodating portion 42*c*1, and the opening on the other end-side is closed by the cover member 66.

In addition, the worm accommodating portion 42*c*2 has a substantially cylindrical shape. Further, the worm accommodating portion 42*c*2 is configured so that an inner diameter is slightly larger than the outer diameter of the worm 48*b* and a dimension in an axis line direction thereof is slightly smaller than an outer diameter of the wheel accommodating portion 42*c*1. Further, the worm accommodating portion 42*c*2 is formed integrally with the wheel accommodating portion 42*c*1 on an outer peripheral surface of the wheel accommodating portion 42*c*1, a direction in which an axis line direction thereof is made to be orthogonal to the axis line direction of the wheel accommodating portion 42*c*1. Further, in such an integrally formed state, the wheel accommodating portion 42*c*1 and the worm accommodating portion 42*c*2 are in a state where their internal spaces are connected to each other.

The worm shaft 48*c* is accommodated in the worm accommodating portion 42*c*2 in such a form that the worm wheel 48*a* and the worm 48*h* accommodated in the wheel accommodating portion 42*c*1 mesh with each other. More specifically, the drive transmission shaft 44 is rotatably supported by the gear case 42 (wheel accommodating portion 42*c*1), as described later. In addition, the support is made in such a form that the axis line direction of the drive transmission shaft 44 is made to coincide with the axis line direction of the wheel accommodating portion 42*c*1 forming a cylindrical shape and a shaft center of the drive transmission shaft 44 is made to substantially coincide with a center of the wheel accommodating portion 42*c*1, when seen in the axis line direction. Further, the worm wheel 48*a* is accommodated in the wheel accommodating portion 42*c*1 in a state of being fitted to one end portion of the drive transmission shaft 44. Note that, in this state, the worm wheel 48*a* is provided in such an arrangement that a center of gear teeth thereof substantially coincides with a center of the worm accommodating portion 42*c*2 having a cylindrical shape, in the axis line direction.

Further, the worm shaft 48*c* is accommodated in the worm accommodating portion 42*c*2 in such an arrangement that the worm 48*b* meshes with the worm wheel 48*a* provided as described above in the axis line direction thereof. Note that, the worm shaft 48*c* is rotatably supported in the worm accommodating portion 42*c*2 via a bearing or the like (not shown). Further, the worm shaft 48*c* is provided in a form that one end portion thereof protrudes from the opened one end-side of the worm accommodating portion 42*c*2 in the state of being accommodated (supported) in this way.

In addition, the gear accommodating portion 42*c*3 is a portion configured to accommodate gears (the transmission gear 48*d*, the motor gear 48*e*) configured to connect the worm shaft 48*c* and the output shaft of the transmission motor M as described above, and in the shown configuration, is formed integrally with the worm accommodating portion 42*c*2. Specifically, the gear accommodating portion 42*c*3 is provided integrally with the worm accommodating portion 42*c*2 in such a form that one of both side surfaces thereof is continuous with an end edge on the above-described opened one end-side of the worm accommodating portion 42*c*2. Note that, one end portion of the worm shaft 48*c* protrudes from the opened one end-side of the worm accommodating portion 42*c*2. Therefore, one side surface of the gear accommodating portion 42*c*3 is formed with a through-hole in which one end portion of the worm shaft 48*c* is inserted. Thereby, the worm shaft 48*c* is in a state where one end portion thereof is located in the gear accommodating portion 42*c*3. Further, the transmission gear 48*d* is fixed to one end portion of the worm shaft 48*c* located in the gear accommodating portion 42*c*3.

In addition, the delivery motor M is attached to the other side surface of the gear accommodating portion 42*c*3 in a direction in which an axis line direction of the output shaft is made to coincide with the axis line direction of the worm shaft 48*c* and the output shaft is directed toward one side surface of the gear accommodating portion 42*c*3. Therefore, the other side surface of the gear accommodating portion 42*c*3 is formed with a through-hole in which the output shaft of the delivery motor M is inserted. Thereby, in a state where the delivery motor M is attached to the gear accommodating portion 42*c*3, most of the output shaft of the delivery motor M is located in the gear accommodating portion 42*c*3. Further, the motor gear 48*e* is fixed to the output shaft of the delivery motor M, as described above. The motor gear 48*e* and the transmission gear 48*d* are in a state of meshing with each other in the gear accommodating portion 42*c*3.

Further, the gear case 42 has the second attaching portion 42*b*, which is a portion for attaching the gear case to the main body frame 31, as described above. More specifically, the wheel accommodating portion 42*c*1 of the gear train accommodating portion 42*c* has a substantially cylindrical shape, as described above, the opening on one end-side thereof is smaller than the opening on the other end-side, and the inner diameter of the opening on one end-side is about a half of the opening on the other end-side. Therefore, the wheel accommodating portion 42*c*1 has a wall portion 42*c*4 provided on the one end-side and extending in a radial direction with respect to the opening on the other end-side. In addition, the gear case 42 has four columnar leg portions 42*b*1 extending from the wall portion 42*c*4 in the axis line direction of the wheel accommodating portion 42*c*1, and the second attaching portion 42*b* is constituted by the four columnar leg portions 42*b*1.

Note that, the four leg portions 42*h*1 are formed on the wall portion 42*c*4 around the opening on one end-side of the wheel accommodating portion 42*c*1, when seen in the axis line direction of the wheel accommodating portion 42*c*1. In addition, positions Where the four leg portions 42*b*1 are formed are positions that can be aligned with the positions of the four through-holes 56*b*1 formed in the first attaching portion 56*b* of the first bearing case 56. Further, the four leg portions 42*b*1 are formed so that positions thereof with respect to the wheel accommodating portion 42*c*1 are positions where the shaft center of the first hearing case 56 and a shaft center of the wheel accommodating portion 42*c*1 coincide with each other, when seen in the axis line direction of the first bearing case 56 (wheel accommodating portion 42*c*1), in the state where the positions are aligned with the positions of the four through-holes 56*b*1 as described above.

Further, as described above, in the present embodiment, the first bearing case 56 and the second bearing case (gear case 42) are attached to the side frame 3 (main body frame 31) by a common screw member. The common screw member is the screw member 62 described above. Therefore, as shown in FIG. 6, an end surface of each leg portion 42*b*1 is formed with a female screw hole 42*b*3 in which the screw member 62 is screwed. In addition, the main body frame 31 is formed with four insertion holes 31*b* in which the screw members 62 are inserted.

Further, the gear case 42 is attached to the main body frame 31 by using a positioning pin (not shown) in a state where the position of the gear case 42 with respect to the main body frame 31 is fixed, as in the first bearing case 56.

Therefore, the main body frame 31 is provided with two positioning pins in a form of protruding from an outer surface (outer side wall) in the vicinity of the upper and lower edges of the elongated hole portion 31*a*2 of the through-hole 31*a*. In addition, end faces 42*b*2 of the corresponding two leg portions 42*b*1 of the four leg portions 42*b*1 are formed with positioning holes (not shown) in which the positioning pins are fitted.

In addition, the gear case 42 has a second support portion 42*a* as a portion configured to accommodate therein the second hearing 54, in the wheel accommodating portion 42*c*1. More specifically, the gear case 42 is configured to include the second support portion 42*a* formed integrally with the wall portion 42*c*4 of the wheel accommodating portion 42*c*1. As shown in FIG. 6, the second support portion 42*a* has a substantially cylindrical shape whose both ends are opened, and is formed integrally with the wall portion 42*c*4 in a form of protruding from an inner surface of the wall portion 42*c*4 toward an inside of the wheel accommodating portion 42*c*1. Note that, the second support portion 42*a* is formed at a position where a shaft center thereof coincides with the shaft center of the wheel accommodating portion 42*c*1, when seen in the axis line direction. Further, the second support portion 42*a* is a portion configured to accommodate therein the second bearing 54, as described above, and is configured so that an inner diameter thereof is large enough to fit the second bearing 54 and a dimension in the axis line direction is slightly larger than a thickness dimension of the second bearing 54.

In addition, the inner diameter of the second support portion 42*a* is larger than the opening on one end-side of the wheel accommodating portion 42*c*1 described above.

Therefore, the second support portion 42*a* is configured such that a portion of the wall portion 42*c*4 exists on an inner side of the second support portion on the wall portion 42*c*4-side, when seen in the axis line direction. Further, in the second support portion 42*a*, the second bearing 54 is accommodated in a state of being in contact with the wall portion 42*c*4.

In the support structure 50 described above, the first bearing case 56 and the gear case (second bearing case) 42 are attached to the main body frame 31 by the common screw members 62 described above in a form of sandwiching the main body frame 31.

Note that, in attaching, the first bearing case 56 is arranged inside the loom frame 2, as described above, and is in contact with the inner surface of the main body frame 31 in a state of being positioned by the positioning pins 64. Further, the gear case 42 is arranged outside the loom frame 2, and is in contact with the outer surface of the main body frame 31 on the end surface 42*b*2 of each leg portion 42*b*1 of the second attaching portion 42*b*, in a state of being positioned by the positioning pins protruding from the outer surface of the main body frame 31. In this state, the positions of the through-holes 56*b*1 formed in the first attaching portion 56*b* of the first bearing case 56 and the female screw holes 42*b*3 formed in the end surface 42*b*2 of the second attaching portion 42*b* of the gear case 42 coincide with each other with respect to the insertion holes 31*b* formed in the main body frame 31, when seen in the axis line direction of the first support portion 56*a* (second support portion 42*a*).

Further, the screw members 62 are inserted into the through-holes 56*b*1 of the first bearing case 56 from the first bearing case 56-side (inner side of the loom frame 2), are inserted into the insertion holes 31*b* of the main body frame 31, and are screwed into the female screw holes 42*b*3 of the gear case 42. Thereby, the first bearing case 56 and the gear case (second bearing case) 42 are attached (fixed) to the main body frame 31 in a form of sandwiching the main body frame 31.

Note that, in the attached state, the first support portion 56*a* and the second support portion 42*a* are in a state where the shaft centers thereof coincide with each other, when seen in the axis line direction of the first support portion 56*a* of the first bearing case 56 (the second support portion 42*a* of the gear case 42). In addition, the drive transmission shaft 44 is supported by the first bearing case 56 and the gear case 42 in such a form that the first bearing 52 accommodated in the first support portion 56*a* is externally fitted inside the loom frame 2 and the second bearing 54 accommodated in the second support portion 42*a* is externally fitted outside the loom frame.

Thereby, the drive transmission shaft 44 is rotatably supported by the main body frame 31. In a state where the drive transmission shaft 44 is supported in this way, the pinion gear 46 fixed to one end portion of the drive transmission shaft 44 is in mesh with the beam gear 17 of the warp beam 15, and the worm wheel 48*a* is in mesh with the worm 48*b* supported (accommodated) by the worm accommodating portion 42*c*2 of the gear train accommodating portion 42*c* of the gear case 42.

According to the loom 1 of the present embodiment configured as described above, the support structure 50 is configured such that the first bearing 52 is accommodated in the first bearing case 56 attached to the inner surface of the main body frame 31 (inside the loom frame 2) and the second bearing 54 is accommodated in the gear case 42, which also serves as the second bearing case attached to the outer surface of the main body frame 31 (outside the loom frame 2). Therefore, the support structure 50 can arrange both the bearings of the first bearing 52 and the second bearing 54 at positions closer to the main body frame 31 (side frame 3), as compared to a support structure of the related art where the first bearing and the second bearing are accommodated in a common bearing case.

Thereby, in the support structure 50, a distance between a position where each bearing case (the first bearing case 56 and the gear case 42) is attached to the main body frame 31 and a position where the bearing is accommodated becomes small. Therefore, a moment force that acts on the attaching portion of the bearing case as each bearing case receives a force from the bearing accommodated therein due to vibration of the loom frame 2 becomes small. Moreover, since the bearing case is provided for each bearing, the force that is received from the bearing by the bearing case due to the vibration becomes smaller, as compared to a configuration where the two bearings are accommodated in a common bearing case, like the support structure of the related art. As a result, the force that acts on the attaching portion of each bearing case due to the vibration becomes smaller, as compared to the support structure of the related art.

In this way, in the support structure 50, the force that acts on the attaching portion of each bearing case due to the vibration can be made as small as possible, as compared to the support structure of the related art. Thereby, it is possible to suppress wear and the like occurring on the attaching portion, which are caused due to the force, and as a result, it is possible to suppress damage to each constitutional component in the drive mechanism 40, such as each bearing case, both the bearings, the drive transmission shaft 44 and each gear member.

Further, in the loom 1 of the present embodiment, the first bearing case 56 and the gear case 42 are attached to the main body frame 31 by the common screw members 62, so that the first bearing case 56 and the gear case 42 are attached to the main body frame 31 in a form of sandwiching the main body frame 31. Thereby, as compared to a case where the first bearing case 56 and the gear case 42 are individually attached to the main body frame 31, the first bearing case 56 and the gear case 42 can be more firmly attached to the main body frame 31 (side frame 3). As a result, it is possible to make it difficult for the wear and the like to occur on the attaching portions of the first bearing case 56 and the gear case 42.

Note that, the present invention is not limited to the above-described embodiment (the above embodiment), and can also be implemented in following modified embodiments.

(1) As for the second bearing case, in the above embodiment, the gear case for accommodating the gear train connected to the drive transmission shaft is configured to serve as the second bearing case. However, in the present invention, the second hearing case may be a case configured to accommodate at least the second bearing, and may also be configured as a member separate from the gear case.

Specifically, for example, the second bearing case is mainly constituted by a part formed in a substantially cylindrical shape whose both ends are opened, as in the first hearing case 56 of the above embodiment, and the second bearing case is configured to have a flange-shaped part for attaching the second bearing case to the side frame. In addition, the second hearing case may be configured to accommodate therein the second bearing and to be attached to the outer surface of the side frame at the flange-shaped part. Note that, in this case, the gear case provided as a separate member from the second bearing case is attached at a more outer position than the second bearing case with respect to the side frame to the side frame or the like by an appropriate attaching means, in such an arrangement that a center of the worm wheel of the accommodated gear train can be made to coincide with the shaft center of the second bearing accommodated in the second bearing case, when seen in the width direction of the loom.

(2) As for the configuration of attaching the first bearing case and the second bearing case constituting the support structure to the side frame, in the support structure 50 of the above embodiment, the first bearing case 56 and the gear case 42 also serving as the second bearing case are attached to the main body frame 31 (side frame 3) in a form of being together fastened by the common screw members 62, However, the support structure in the present invention is not limited to such a configuration that the first bearing case and the second bearing case are attached by the common screw member, and may also be configured so that the first bearing case and the second bearing case are attached by a screw member provided for each of the bearing cases.

Note that, each bearing case may also be attached to the side frame in such a form that the screw member inserted in the side frame is screwed into the bearing case, as in the second bearing case of the above embodiment, or in such a form that the screw member inserted in the flange-shaped part of the bearing case is screwed into the side frame. Further, in the latter case, the side frame may be formed with a separate female screw hole for each bearing case. Alternatively, it is also possible to screw the screw member from each bearing case-side into a female screw hole formed to penetrate the side frame, as a female screw hole common to both the bearing cases.

(3) As for the loom of the preamble, in the above embodiment, the loom 1 is configured such that the drive source of the drive mechanism 40 for rotationally driving the warp beam 15 (beam gear 17) is the delivery motor M. However, the loom to which the present invention is applied may also be configured such that the drive source of the drive mechanism for rotationally driving the warp beam (beam gear) is a main shaft of the loom.

Note that, the present invention is not limited to the above-described example, and can be appropriately changed without departing from the gist of the present invention.

The invention claimed is:

1. A loom comprising a loom frame including a pair of side frames connected by a plurality of beam members on each side wall;

a drive transmission shaft connected to a warp beam via a gear member inside the loom frame including the pair of side frames, the drive transmission shaft being inserted in a through-hole formed in the side wall of one of the pair of the side frames; and a support structure for supporting the drive transmission shaft, the support structure including a first bearing and a second bearing externally fitted to the drive transmission shaft at an interval in an axis line direction, wherein the support structure comprises a first bearing case configured to accommodate therein the first bearing and attached to an inner surface of the side wall of the one side frame, and a second bearing case configured to accommodate therein the second bearing and attached to an outer surface of the side wall.

2. The loom according to claim 1, wherein the first bearing case and the second bearing case are attached to the side wall by a common screw member.

* * * * *